US009297242B2

(12) United States Patent
Zhang et al.

(10) Patent No.: US 9,297,242 B2
(45) Date of Patent: Mar. 29, 2016

(54) STRUCTURE FOR GUNPOWDER CHARGE IN MULTI-FRAC COMPOSITE PERFORATING DEVICE

(71) Applicants: TONG PETROTECH INC, Houston, TX (US); Tong Oil Tools Co., Ltd, Xi'an, Shaanxi (CN)

(72) Inventors: Guoan Zhang, Xi'an (CN); Jianlong Cheng, Xi'an (CN); Xianhong Sun, Xi'an (CN)

(73) Assignees: Tong Oil Tools Co., Ltd., Xi'an (CN); Tong Petrotech Inc, Houston, TX (US)

( * ) Notice: Subject to any disclaimer, the term of this patent is extended or adjusted under 35 U.S.C. 154(b) by 0 days.

(21) Appl. No.: 14/580,750

(22) Filed: Dec. 23, 2014

(65) Prior Publication Data

US 2015/0107831 A1 Apr. 23, 2015

Related U.S. Application Data

(63) Continuation-in-part of application No. 13/814,243, filed as application No. PCT/US2012/069606 on Dec. 14, 2012, now Pat. No. 8,943,944, which is a continuation-in-part of application No. 13/814,242, filed as application No. PCT/US2012/069607 on Dec. 14, 2012.

(30) Foreign Application Priority Data

Dec. 15, 2011 (CN) ..... 2011 1 0426049
Dec. 15, 2011 (CN) ..... 2011 2 0533902

(51) Int. Cl.
*B64D 1/04* (2006.01)
*E21B 43/263* (2006.01)
*E21B 43/117* (2006.01)

(52) U.S. Cl.
CPC ..... *E21B 43/263* (2013.01); *E21B 43/117* (2013.01)

(58) Field of Classification Search
CPC ..... F42D 1/05; F42D 1/04; F42D 1/055
USPC ..... 89/1.15; 175/4.55–4.59
See application file for complete search history.

(56) References Cited

U.S. PATENT DOCUMENTS 2,837,995 A 6/1958 Castel
2,980,017 A 4/1961 Castel
(Continued)

FOREIGN PATENT DOCUMENTS

CN 2270115 12/1997
CN 2309419 3/1999
(Continued)

OTHER PUBLICATIONS

Sep. 15, 2011 Office Action for CN 200910218911.0.
Mar. 5, 2012 Office Action for CN 200910218911.0 .
Jul. 6, 2013 2nd Office Action for CN 201010609790.5.
(Continued)

*Primary Examiner* — Samir Abdosh
(74) *Attorney, Agent, or Firm* — Law Offices of Albert Wai-Kit Chan, PLLC

(57) ABSTRACT

This invention provides a multi-frac composite perforation device having (i) a gun body having an outer wall, (ii) an inner gunpowder box between adjacent perforating charges in the charge frame 1 of said perforation device, and (iii) a structure for gunpowder charge with an outer gunpowder box 4 attached to an outer wall of the charge frame 1, the gun body has a pressure releasing structure corresponding to a closed end of the perforating charge. This invention further provides a method of using the multi-frac composite perforating device to fracture a formation and the choice of gunpowders and gun body thickness with regards to the pressure required for fracturing a formation.

19 Claims, 12 Drawing Sheets

(56) References Cited

U.S. PATENT DOCUMENTS

| | | | | |
|---|---|---|---|---|
| 3,620,314 | A | | 11/1971 | Bohn |
| 4,191,265 | A | | 3/1980 | Bosse-Platiere |
| 4,253,523 | A | | 3/1981 | Ibsen |
| 4,627,353 | A | | 12/1986 | Chawla |
| 4,633,951 | A | | 1/1987 | Hill et al. |
| 4,683,943 | A | | 8/1987 | Hill et al. |
| 4,760,883 | A | | 8/1988 | Dunn |
| 4,823,875 | A | | 4/1989 | Hill |
| 4,976,318 | A | * | 12/1990 | Mohaupt ..... 166/311 |
| 5,355,802 | A | | 10/1994 | Petitjean |
| 5,775,426 | A | | 7/1998 | Snider et al. |
| 5,885,321 | A | | 3/1999 | Higa et al. |
| 6,082,450 | A | | 7/2000 | Snider et al. |
| 6,186,230 | B1 | | 2/2001 | Nierode |
| 6,439,121 | B1 | | 8/2002 | Gillingham |
| 6,497,285 | B2 | | 12/2002 | Walker |
| 6,837,310 | B2 | | 1/2005 | Martin |
| 7,216,708 | B1 | | 5/2007 | Bond et al. |
| 7,913,761 | B2 | | 3/2011 | Pratt et al. |
| 2002/0134585 | A1 | | 9/2002 | Walker |
| 2002/0189802 | A1 | | 12/2002 | Tolman et al. |
| 2003/0037692 | A1 | | 2/2003 | Liu |
| 2003/0150646 | A1 | | 8/2003 | Brooks et al. |
| 2004/0129415 | A1 | | 7/2004 | Zhang et al. |
| 2004/0216866 | A1 | | 11/2004 | Barlow et al. |
| 2005/0115441 | A1 | | 6/2005 | Mauldin |
| 2005/0139352 | A1 | | 6/2005 | Mauldin |
| 2006/0118303 | A1 | | 6/2006 | Schultz et al. |
| 2009/0078420 | A1 | | 3/2009 | Caminari et al. |
| 2009/0183916 | A1 | | 7/2009 | Pratt et al. |
| 2010/0258292 | A1 | | 10/2010 | Tiernan et al. |
| 2010/0276136 | A1 | | 11/2010 | Evans et al. |
| 2011/0240311 | A1 | | 10/2011 | Robison et al. |
| 2013/0098681 | A1 | | 4/2013 | Zhang et al. |
| 2013/0145924 | A1 | | 6/2013 | Zhang et al. |
| 2013/0146287 | A1 | | 6/2013 | Zhang et al. |
| 2013/0206385 | A1 | | 8/2013 | Feng et al. |

FOREIGN PATENT DOCUMENTS

| | | | |
|---|---|---|---|
| CN | 2314091 | | 4/1999 |
| CN | 2348095 | | 11/1999 |
| CN | 2376535 | | 5/2000 |
| CN | 2386194 | | 7/2000 |
| CN | 2391987 | | 8/2000 |
| CN | 2437852 | | 7/2001 |
| CN | 1312882 | | 9/2001 |
| CN | 2453132 | | 10/2001 |
| CN | 2485421 | | 4/2002 |
| CN | 2555393 | | 6/2003 |
| CN | 1143944 | | 3/2004 |
| CN | 2611593 | | 4/2004 |
| CN | 2628724 | | 7/2004 |
| CN | 2630491 | | 8/2004 |
| CN | 2630493 | | 8/2004 |
| CN | 2653125 | | 11/2004 |
| CN | 2682199 | | 3/2005 |
| CN | 2695631 | | 4/2005 |
| CN | 2818773 | | 9/2006 |
| CN | 2818774 | | 9/2006 |
| CN | 2821154 | | 9/2006 |
| CN | 2821154 | Y | 9/2006 |
| CN | 2846740 | | 12/2006 |
| CN | 2854071 | | 1/2007 |
| CN | 1916357 | | 2/2007 |
| CN | 2866810 | | 2/2007 |
| CN | 200968200 | | 10/2007 |
| CN | 201045293 | | 4/2008 |
| CN | 100491692 | | 5/2009 |
| CN | 201358768 | | 12/2009 |
| CN | 201396090 | | 2/2010 |
| CN | 201412133 | | 2/2010 |
| CN | 201531256 | | 7/2010 |
| CN | 201568033 | | 9/2010 |
| CN | 201568038 | | 9/2010 |
| CN | 201620848 | | 11/2010 |
| CN | 101952542 | | 1/2011 |
| CN | 102031952 | | 4/2011 |
| CN | 201843593 | | 5/2011 |
| CN | 102094613 | | 6/2011 |
| CN | 201865649 | | 6/2011 |
| CN | 201884014 | | 6/2011 |
| CN | 201934084 | | 8/2011 |
| CN | 201934084 | U | 8/2011 |
| CN | 201934086 | | 8/2011 |
| CN | 201991504 | | 9/2011 |
| CN | 202055812 | | 11/2011 |
| CN | 102410006 | | 4/2012 |
| CN | 102518419 | | 6/2012 |
| CN | 1690357 | | 7/2012 |
| CN | 202391399 | | 8/2012 |
| CN | 102011561 | | 4/2013 |
| CN | 102052068 | | 4/2013 |
| CN | 102022101 | | 7/2013 |
| WO | 02/063133 | | 8/2002 |
| WO | 2011057564 | | 5/2011 |
| WO | 2011057564 | A1 | 5/2011 |
| WO | 2012088984 | | 7/2012 |
| WO | 2012088985 | | 7/2012 |
| WO | 2013090647 | | 6/2013 |
| WO | 2013123268 | | 8/2013 |
| WO | 2013130166 | | 9/2013 |

OTHER PUBLICATIONS

Jul. 11, 2013 1st Office Action for CN 201110426049.X.
Feb. 10, 2011 International Search Report for PCT/CN2010/078601.
Mar. 15, 2012 International Search Report for PCT/CN2011/083112.
Mar. 8, 2013 International Search Report for PCT/CN2011/083113.
Aug. 6, 2013 International Search Report for PCT/US2012/069606.
Feb. 28, 2013 International Search Report for PCT/US2012/069607.
Feb. 10, 2011 Written Opinion for PCT/CN2010/078601.
Mar. 15, 2012 Written Opinion for PCT/CN2011/083112.
Mar. 8, 2013 Written Opinion for PCT/CN2011/083113.
Aug. 6, 2013 Written Opinion for PCT/US2012/069606.
Feb. 28, 2013 Written Opinion for PCT/US2012/069607.
Zhang, 2009, "Mechanism Difference and Safety Analysis of Different Composite Perforators Types", Testing of Oil and Gas Wells, vol. 18(4), pp. 59-61.
Zhao, 2007, "Efficiency Monitoring, Comparison Analysis and Optimization of Composite Perforators", Well logging technology, vol. 31(1), p. 66-71.
Zhang et al., 1986, "Preliminary study on high energy gas fracturing", Journal of Xi'an Petroleum Institute, vol. 1 (2).
Liu et al., 2006, "The discussion for a built-in composite perforator with twice synergism", Conference paper of the fifth annual conference of the perforating branch of the Professional Committee of well testing in the Chinese Petroleum Society.
Yao et al., 2006, "Experimental study on the effect of sleeve powder influenced on the perforating depth of composited perforator", Conference on new developments in perforation technology by the perforating branch of the Professional Committee of well logging in the Chinese Petroleum Society.
Feng et al., 1996, "Analysis on two-stage charge combustion characteristics and/or fracturing action procedure of multiple impulse combined perforation", Explosive Materials, vol. 75 (4), 130-133.
Zhao et al., 2005, "Research on Powder Combustion Characteristics of Various Combined Perforators", Well logging technology, vol. 30 (1) , 44-46.
Wang et al., 2002, "Situation and Tendency of Combined Perforating Techniques", Explosive materials, vol. 31 (3), 30-34.
Sun et al., 2007 "Review on combined perforation technology", Explosive materials, vol. 36 (5).
Feng et al., 2005, "Research on multiple-impulses composite perforating technique", Explosive materials, vol. 34 (1), 32-36.
Zhu, 1993, "Development of Foreign Petroleum Perforation Equipment", Explosive Materials, vol. 75(4).
Nov. 22, 2012 Office Action for CN 201010609790.5.
Sep. 27, 2012 Office Action for CN 200910218911.0.
Jun. 25, 2014 Office Action for U.S. Appl. No. 13/814,242.

* cited by examiner

STRUCTURE FOR GUNPOWDER CHARGE IN MULTI-FRAC COMPOSITE PERFORATING DEVICE

This application is a Continuation-in-part application of U.S. application Ser. No. 13/814,243, filed Feb. 5, 2013, which is the national stage application of International Application PCT/US12/69606, filed Dec. 14, 2012 which claims benefit of Chinese application CN 201110426049.X, filed Dec. 15, 2011. This application is also a Continuation-in-part application of U.S. application Ser. No. 13/814,242, filed Feb. 5, 2013, which is the national stage application of International Application PCT/US12/69607, filed Dec. 14, 2012 which claims benefit of Chinese application CN 201120533902.3, filed Dec. 15, 2011. The content of the preceding applications are hereby incorporated in its entirety by reference into this application. Throughout this application, various publications are referenced. Disclosures of these publications in their entireties are hereby incorporated by reference into this application in order to more fully describe the state of the art to which this invention pertains.

FIELD OF THE INVENTION

The present invention relates to the field of oil exploration and exploitation, especially to a structure for gunpowder charge in multi-frac composite perforating devices.

BACKGROUND OF THE INVENTION

Currently, an integrated composite perforating gun with the gunpowder charged in the gun has been widely used in the oil field because it is simple to construct, safe and reliable, and causes less damage to the well bore. However, as the gunpowder is charged between the perforating charges in most integrated composite perforating gun, the amount of gunpowder charged is drastically decreased especially in cases where hole density is high, causing the effect to be very poor. Multi-frac composite perforating device was then developed and utilized the time difference between the pressure peak values of two types of gunpowders charged inside and outside of the charge frame of the perforating gun to extend the effective plateau pressure and enhance the efficiency of the high pressure gas and the penetrating depth of the perforating charge. However, test results showed that the duration of the effective pressure of the multi-frac composite perforating device still need further improvement. The applicant considers further increasing the charge volume of the perforating gun and the use of a combination of gunpowders to be one of the ways to overcome this problem.

SUMMARY OF THE INVENTION

In one embodiment, the present invention provides a structure for gunpowder charge in multi-frac combined perforating devices, which can increase the charge volume, prolong the duration of the effective pressure and thus enhance the fracturing effect.

As the size of the perforating gun is limited, in order to increase the charge volume, one needs to make the most use of the available space of the perforating gun whilst ensuring safety during transportation and usage. It is considered by the applicant that the area facing the perforating charge outside of the charge frame of the perforating gun has always been a blank area and can be used for charging gunpowder. The applicant has proved by experimentation that this charge mode is safe.

In one embodiment, there is provided a structure for gunpowder charge in a multi-frac combined perforating device that comprises an inner gunpowder box located inside the charge frame of the perforating gun and between adjacent shaped charges. In one embodiment, the present invention allows at least three types of gunpowders with different burning rates to be contained in a multi-frac composite perforating device. In one embodiment, a triplet outer gunpowder box 4 is fitted to the outer wall of a charge frame 1, said triplet outer gunpowder box 4 comprises one middle gunpowder box 3 and two side-hung gunpowder boxes 2, said side-hung gunpowder box 2 comprises gunpowder boxes 2A and 2B which are separately located on each side of the middle gunpowder box 3. In one embodiment, gunpowder P is charged in the middle gunpowder box 3 located outside the charge frame, gunpowder Q is charged in the inner gunpowder box located between adjacent perforating charges inside the charge frame, and gunpowder R is charged in the side-hung gunpowder box 2 located outside the charge frame. The gunpowder R comprises gunpowders R1 and R2 charged separately in the gunpowder boxes 2A and 2B, respectively. The burning rates of gunpowders R1 and R2 are not necessarily the same.

The charge frame 1 can be of several shapes; in some embodiments, the shape of the axial section of said charge frame can be cylindrical, rectangular or oval.

The middle gunpowder box 3 is connected with the two side-hung gunpowder boxes 2A and 2B to form a single unit. In one embodiment, the middle gunpowder box 3 is hinge-connected to the two side-hung gunpowder boxes 2A and 2B; in another embodiment, the boxes are connected by a flexible connector belt; in a further embodiment, the boxes are bonded together with adhesives.

In one embodiment, the middle gunpowder box 3 is located at a position corresponding to an open end of a perforating charge (i.e. the jet emitting end), and has an inner groove 32 for orienting the perforating charge and a through hole 33 through which the jet flow passes. In one embodiment, the inner groove 32 is arc-shaped and complements the shape of the perforating charge. In another embodiment, the shape of said through hole 33 can be circular, polygonal, oval or curves.

In one embodiment, the gunpowders are divided into high burning rate gunpowder, middle burning rate gunpowder and low burning rate gunpowder based on their burning rate. The pressure-time (P-T) graphs of the three types of gunpowders are shown in FIG. 9. The peak values for each gunpowder are known as its endpoint of combustion and are shown in FIG. 9 as $t_H$, $t_M$ and $t_L$ for high burning rate gunpowder, middle burning rate gunpowder and low burning rate gunpowder respectively.

In this invention, gunpowders are graded according to the technical parameter endpoint of combustion. In one embodiment, the range of endpoint of combustion for high burning rate gunpowder, $t_H$, is about 25-80 ms; the range of endpoint of combustion for middle burning rate gunpowder, $t_M$, is about 80-280 ms; and the range of endpoint of combustion for low burning rate gunpowder, $t_L$, is about 300-800 ms.

The order to ignite the different types of gunpowder in the multi-frac composite perforating device can be optimally designed for adaptation to formations in different regions with different reservoir characteristics. In one embodiment, the configuration of high burning rate gunpowder, middle burning rate gunpowder and low burning rate gunpowder charged in their respective gunpowder boxes can be permutated to give several tens of charge modes. In another embodiment, gunpowder P charged in the middle gunpowder box 3 outside of the charge frame is high burning rate gunpowder, gunpowder Q charged in the inner gunpowder box between adjacent perforating charges inside the charge frame is low burning rate gunpowder, and gunpowders R1 and R2 charged in the side-hung powder cases 2A and 2B outside the charge frame are middle burning rate gunpowders with the same burning rate.

The proppant may also be charged in the side-hung powder cases 2A and 2B outside the charge frame. In one embodiment, gunpowder box 2A is entirely charged with proppant, while gunpowder box 2B is entirely charged with gunpowder. In another embodiment, gunpowder box 2A is entirely charged with gunpowder, while gunpowder box 2B is only charged with proppant. In another embodiment, gunpowder box 2A are charged with both gunpowder and proppant, while gunpowder box 2B are charged with both gunpowder and proppant. In yet another embodiment, gunpowder box 2A is entirely charged with gunpowder, while both gunpowder and proppant are charged in gunpowder box 2B. During the perforation process, proppant from the side-hung gunpowder boxes can get into the formation along with the jet flow to support the crack formed and prevent the crack from closing, thus improving the seepage of the oil and gases.

In one embodiment, the triplet outer gunpowder box is attached to the outer wall of the charge frame by clamping, e.g., a claw is provided on the inside of the side-hung gunpowder boxes, and is fitted into an installation hole on the charge frame or inserted into a groove on the charge frame.

In another embodiment, the triplet outer gunpowder box is attached onto the outer wall of the charge frame by a spring jig which implements the connection to the charge frame by a matching structure of a lock hook and a lock catch, e.g., a lock hook is provided on the outer side of one of the side-hung gunpowder boxes, and a lock catch matched to the lock hook is provided on the outer side of the other side-hung gunpowder box. This structure is simpler and facilitates on-site assembly.

The charge volume can be increased by using the above charge arrangement to charge gunpowder with different burning rates into the gun and achieve the goal of prolonging the acting time of the pressure. The triplet outer gunpowder box is made of materials with high resistant to both cold and heat, thereby expanding the regions and types of formations for using this product.

In one embodiment, the perforating charge is ignited by the prima cord during perforation, the product from the explosion of the perforating charge first ignites gunpowder P in the middle gunpowder box 3 of the triplet outer gunpowder box, and then ignites gunpowder Q charged in the inner gunpowder box located between adjacent perforating charges inside the charge frame, and finally ignites gunpowders R1 and R2 charged in the side-hung gunpowder boxes 2A and 2B of the triplet outer gunpowder box outside the charge frame. In one embodiment, the time difference between the pressure peaks of the middle burning rate gunpowder and the high burning rate gunpowder is about 5-10 ms, and the time difference between the pressure peaks of the low burning rate gunpowder and the middle burning rate gunpowder is about 20-50 ms. Because of the time difference between the pressure peak among gunpowder of different burning rates, energy complementation is achieved, and the duration of the effective pressure in the tunnel is longer and up to 25-60 ms, thus fully enhanced the energy utilization and extended the length of the crack. The duration of the effective pressure 25~60 ms is the sum of the 5~10 ms time difference between the pressure peaks of the middle burning rate gunpowder and the high burning rate gunpowder and the 20~50 ms time difference between the pressure peaks of the low burning rate gunpowder and the middle burning rate gunpowder.

The duration of the effective pressure can be determined after matching gunpowder P in the middle gunpowder box of the triplet outer gunpowder box, gunpowder Q in the inner gunpowder box located between adjacent perforating charges, gunpowders R1 and R2 in the side-hung gunpowder boxes 2A and 2B of the triplet outer gunpowder box with high burning rate gunpowder, middle burning rate gunpowder and low burning rate gunpowder.

As the present invention uses the triplet outer gunpowder box, there is no need to remove the positioning ring during assembly, and the three gunpowder boxes are assembled onto the charge frame simultaneously. Thus the assembly time is reduced and the assembly process is simplified. As compared to the cylindrical gunpowder boxes in the art, the triplet outer gunpowder box of the present invention occupies a smaller space and can be unfolded for easy package during transportation and storage. This drastically reduces the transport and storage cost of gunpowder. This type of structure is also easy for mass and standardized production.

In one embodiment, this invention provides a multi-frac composite perforation device comprising (i) a gun body having an outer wall, (ii) an inner gunpowder box between adjacent perforating charges in the charge frame 1 of said perforation device, and (iii) a structure for gunpowder charge comprising an outer gunpowder box 4 attached to an outer wall of the charge frame 1, wherein said outer gunpowder box 4 comprises a middle gunpowder box 3 and two side-hung gunpowder boxes 2A and 2B, wherein said boxes 2A and 2B are separately located on the two sides of said middle gunpowder box 3, and wherein the gunpowders charged in said inner gunpowder box and outer gunpowder box 4 are classified into three types: high burning rate gunpowder having combustion endpoint of 25~80 ms, middle burning rate gunpowder having combustion endpoint of 80~280 ms and low burning rate gunpowder having combustion endpoint of 300~800 ms; wherein said gun body comprises a pressure releasing structure corresponding to a closed end of the perforating charge.

In one embodiment, the present invention provides a method of using the multi-frac composite perforating device disclosed herein to fracture a formation, comprising the steps of: charging said middle gunpowder box and said two side-hung gunpowder boxes with one or more types of gunpowders selected from the group consisting of high burning rate gunpowder having combustion endpoint of 25~80 ms, middle burning rate gunpowder having combustion endpoint of 80~280 ms, and low burning rate gunpowder having combustion endpoint of 300~800 ms; and placing said device in the formation to fracture said formation.

DETAILED DESCRIPTION OF THE INVENTION

Figure 1:
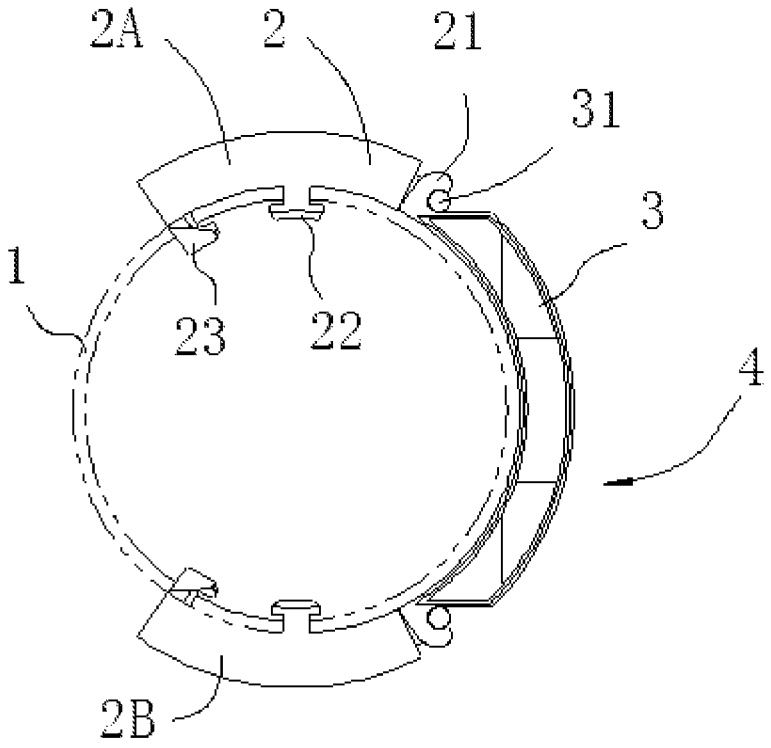
FIG. 1 shows the structure of the embodiment of the triplet outer gunpowder box as shown in Example 1. 1: charge frame; 2, 2A, 2B: side-hung gunpowder boxes; 3: a middle gunpowder box; 4: a triplet outer gunpowder box; 21: a hinge hook; 22: a second claw; 23: a first claw; 31: a hinge shaft.

In one embodiment, the present invention provides a structure for gunpowder charge in multi-frac composite perforation devices having an inner gunpowder box between adjacent perforating charges in the charge frame 1 of said perforation device, said structure for gunpowder charge comprises a outer gunpowder box 4 attached to the outer wall of the charge frame 1, said outer gunpowder box 4 comprises a plurality of compartments for gunpowder, and wherein said inner gunpowder box and said outer gunpowder box 4 contain three or more gunpowders of different burning rates.

In one embodiment, the outer gunpowder box 4 comprises a middle gunpowder box 3 and two side-hung gunpowder boxes 2A and 2B wherein said boxes 2A and 2B are separately located on the two sides of said middle gunpowder box 3.

In one embodiment, the gunpowders charged in said inner gunpowder box and triplet outer gunpowder box 4 are classified into three types: high burning rate gunpowder, middle burning rate gunpowder and low burning rate gunpowder.

In one embodiment, the range for the endpoint of combustion for the high burning rate gunpowder is about 25~80 ms, the range for the endpoint of combustion for the middle burning rate gunpowder is about 80~280 ms and the range for the endpoint of combustion for the low burning rate gunpowder is about 300~800 ms.

In yet another embodiment, the time difference between the pressure peaks of the middle burning rate gunpowder and the high burning rate gunpowder is about 5~10 ms, and the time difference between the pressure peaks of the low burning rate gunpowder and the middle burning rate gunpowder is about 20~50 ms.

In one embodiment, the middle gunpowder box 3 and the two side-hung gunpowder boxes 2A and 2B are connected by a hinging mechanism, strapping with flexible belt or bonding with adhesive. One of ordinary skill in the art would readily employ any suitable hinging mechanism, flexible belt or adhesive to connect the middle gunpowder box 3 and the two side-hung gunpowder boxes 2A and 2B.

In another embodiment, the middle gunpowder box 3 is located at a position opposite to the open end (i. e. the jet emitting end) of a perforating charge.

In some embodiments, the inner side of the middle gunpowder box 3 has an inner groove 32 for orienting the perforating charge and a through hole 33 through which the jet flow passes.

In a further embodiment, the gunpowder P charged in the middle gunpowder box 3 is high burning rate gunpowder, gunpowder Q charged in said inner gunpowder box between adjacent perforating charges inside the charge frame is low burning rate gunpowder, and gunpowders R1 and R2 charged in the side-hung gunpowder boxes 2A and 2B are middle burning rate gunpowders.

In yet another embodiment, the burning rates of gunpowders R1 and R2 are the same or not the same.

In one embodiment, the side-hung gunpowder box 2A or 2B contains proppant.

In one embodiment, the triplet outer gunpowder box 4 is attached to the outer wall of the charge frame 1 by means of clamping, wherein the inner side of the side-hung gunpowder boxes 2A and 2B has claws 22 and 23 for fitting into the installation holes of charge frame 1 or inserting into the grooves of charge frame 1. Alternatively, the triplet outer gunpowder box 4 is attached to the outer wall of the charge frame 1 by means of spring jig, wherein gunpowder box 4 is attached to the outer wall of the charge frame 1 by a matching structure of a lock hook 24 and a lock catch 25.

In one embodiment, the amount and type of gunpowder charged in the gunpowder boxes can be varied based on the pressure required to fracture a formation. For example, less gunpowder may be charged for formations that require less pressure to cause fracture, whereas more gunpowder may be charged for formations that require more pressure to cause fracture. In one embodiment, the pressure required for fracturing each well is determined in silico. In another embodiment, the pressure required for fracturing each well is determined from the dynamic pressure-temperature curves obtained in laboratories. In a further embodiment, different combinations of perforating gun, perforating charge and gunpowder is used in the experiments to determine the pressure peaks, the acting time of the pressure and ultimately the amount of gunpowder to be used.

In one embodiment, the present invention provides a multi-frac composite perforating device having an optimal gun body wall thickness based on the pressure required to fracture a formation. For example, for formations that require high pressure to fracture, the multi-frac composite perforating device will have a thicker gun body wall to withstand the higher pressure resulted from the use of a larger amount of gunpowder. In one embodiment, the optimal gun body wall thickness and the amount of gunpowder used are related to the density of scallops/recessess on the perforating gun, the phase difference between the scallops/recesses and the type of perforating charge being used. In another embodiment, the optimal gun body wall thickness and amount of gunpowder to be used for a specific pressure requirement are determined by ground impact resistance experiments. In one embodiment, a formation is considered to require high pressure to fracture when the required pressure is ≥80 MPa. In another embodiment, when ≥80 MPa is required for fracturing a formation, the thickness of the gun body wall is 10-12 mm. In a further embodiment, when ≤80 MPa is required for fracturing a formation, the thickness of the gun body wall is 8-10 mm.

In another embodiment, the present invention provides a multi-frac composite perforating device comprising one or more perforating charges and a gun body having a pressure releasing structure facing the closed end of the perforating charge. In one embodiment, said pressure releasing structure is a stepped through hole and a sealing cap is mounted on the step of said stepped through hole. When the perforating charge is detonated, the pressure releasing structure would allow the pressure within the gun to be released quickly into the perforation tunnel. Consequently, pressure within the perforation tunnel will be increased quickly, thereby improving the effect of the fracturing.

In another embodiment, this invention provides a method of using the multi-frac composite perforating device disclosed herein to fracture a formation. The amount and type of gunpowder charged in the gunpowder boxes can be varied based on the pressure required to fracture a formation. For example, less gunpowder may be charged for formations that require less pressure to cause fracture, whereas more gunpowder may be charged for formations that require more pressure to cause fracture. In one embodiment, the outer gunpowder boxes are charged with high burning rate gunpowder (high), middle burning rate gunpowder (middle), and low burning rate gunpowder (low) or various combination thereof such as high, high, high; high, high, middle; high, high, low; middle, middle, low etc. In one embodiment, high burning rate gunpowder is used in brittle formations. In another embodiment, low burning rate gunpowder is used in contaminated formations. In a further embodiment, the combination of gunpowder to be used for fracturing a specific formation is determined from the dynamic pressure-temperature curves obtained in laboratories.

In one embodiment, for formations requiring high pressure to fracture and brittle formations, the combination of gunpowder is 50% to 100% high burning rate gunpowder, 0% to 25% middle burning rate gunpowder and 0% to 25% low burning rate gunpowder. In one embodiment, for formations requiring low pressure to fracture and contaminated formations, the combination of gunpowder is 0% to 25% high burning rate gunpowder, 0% to 25% middle burning rate gunpowder and 50% to 100% low burning rate gunpowder. In one embodiment, the percentage of gunpowder refers to the total percentage of gunpowder in both the inner gunpowder box and outer gunpowder box comprises a middle gunpowder box 3 and two side-hung gunpowder boxes 2A and 2B. In another embodiment, only gunpowder of the same burning rate would be charged in a single gunpowder box. In a further embodiment, the amount of gunpowder charged in the two side-hung gunpowder boxes 2A and 2B is the same. For example, in an embodiment where 25% of low burning rate gunpowder, 25% of middle burning rate gunpowder and 50% high burning rate gunpowder are to be used, all high burning rate gunpowder is charged into the middle gunpowder box, the middle burning rate gunpowder is charged into each of the side-hung gunpowder boxes, and all low burning rate gunpowder is charged into the inner gunpowder box.

In one embodiment, this invention provides a multi-frac composite perforation device comprising (i) a gun body having an outer wall, (ii) an inner gunpowder box between adjacent perforating charges in the charge frame 1 of said perforation device, and (iii) a structure for gunpowder charge comprising an outer gunpowder box 4 attached to an outer wall of the charge frame 1, wherein said outer gunpowder box 4 comprises a middle gunpowder box 3 and two side-hung gunpowder boxes 2A and 2B, wherein said boxes 2A and 2B are separately located on the two sides of said middle gunpowder box 3, and wherein the gunpowders charged in said inner gunpowder box and outer gunpowder box 4 are classified into three types: high burning rate gunpowder having combustion endpoint of 25~80 ms, middle burning rate gunpowder having combustion endpoint of 80~280 ms and low burning rate gunpowder having combustion endpoint of 300~800 ms; wherein said gun body comprises a pressure releasing structure corresponding to a closed end of the perforating charge.

In one embodiment, said pressure releasing structure is a stepped through hole and a sealing cap is mounted on the step of said stepped through hole.

In one embodiment, said pressure releasing structure is a recess having a sealing cap mounted in said recess.

In one embodiment, the thickness of said outer wall of the gun body is varied according to the pressure required to fracture a formation.

In one embodiment, the thickness of said outer wall of the gun body is 10-12 mm when ≥80 MPa is required for fracturing a formation.

In one embodiment, the thickness of said outer wall of the gun body is 8-10 mm when ≤80 MPa is required for fracturing a formation.

In one embodiment, wherein the time difference between the pressure peaks of the middle burning rate gunpowder and the high burning rate gunpowder is about 5~10 ms, and the time difference between the pressure peaks of the low burning rate gunpowder and the middle burning rate gunpowder is about 20~50 ms.

In one embodiment, the middle gunpowder box 3 and the two side-hung gunpowder boxes 2A and 2B are connected by a hinging mechanism, strapping with flexible belt or bonding with adhesive.

In one embodiment, said middle gunpowder box 3 is located at a position corresponding to the jet emitting end of a perforating charge.

In one embodiment, said middle gunpowder box 3 has an inner side comprising an inner groove 32 for orienting the perforating charge and a through hole 33 through which the jet flow passes.

In one embodiment, the outer gunpowder box 4 is attached to the outer wall of the charge frame 1 by means of: clamping, wherein the inner side of the side-hung gunpowder boxes 2A and 2B has claws 22 and 23 for fitting into the installation holes of charge frame 1 or inserting into the grooves of charge frame 1; or, spring jig, wherein gunpowder box 4 is attached to the outer wall of the charge frame 1 by a matching structure of a lock hook 24 and a lock catch 25.

In one embodiment, this invention provides a perforation device comprising a perforating portion and a fracturing portion which are connected by an adaptor, wherein said perforating portion comprises the multi-frac composite perforation device of this invention; and said fracturing portion comprises at least one column of gunpowder for fracturing.

In one embodiment, there is provided a method of using the multi-frac composite perforating device disclosed herein to fracture a formation, comprising the steps of: charging said middle gunpowder box and said two side-hung gunpowder boxes with one or more types of gunpowders selected from the group consisting of high burning rate gunpowder having combustion endpoint of 25~80 ms, middle burning rate gunpowder having combustion endpoint of 80~280 ms, and low burning rate gunpowder having combustion endpoint of 300~800 ms; and placing said device in the formation to fracture said formation.

In one embodiment, the gunpowders charged in said middle and side-hung gunpowder boxes are of the same or different types.

In one embodiment, for formations requiring ≥80 MPa to fracture or brittle formations, the combination of gunpowders used is 50% to 100% high burning rate gunpowder, 0% to 25% middle burning rate gunpowder and 0% to 25% low burning rate gunpowder.

In one embodiment, for formations requiring ≤80 MPa to fracture or contaminated formations, the combination of gunpowders used is 0% to 25% high burning rate gunpowder, 0% to 25% middle burning rate gunpowder and 50% to 100% low burning rate gunpowder.

In one embodiment, the thickness of the outer wall of said gun body is varied according to the pressure required to fracture a formation. In another embodiment, the thickness of said outer wall is 10-12 mm when ≥80 MPa is required for fracturing a formation. In a further embodiment, the thickness of said outer wall is 8-10 mm when ≤80 MPa is required for fracturing a formation.

The invention will be better understood by reference to the Experimental Details which follow, but those skilled in the art will readily appreciate that the specific examples are for illustrative purposes only and should not limit the scope of the invention which is defined by the claims which follow thereafter. It is to be noted that the transitional term "comprising", which is synonymous with "including", "containing" or "characterized by", is inclusive or open-ended and does not exclude additional, un-recited elements or method steps.

EXAMPLE 1

Figure 2:
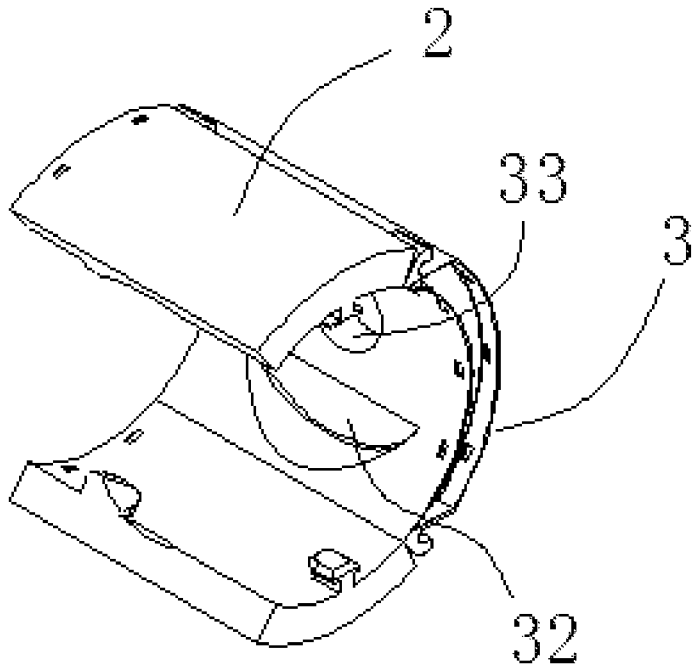
FIG. 2 shows the perspective view of the triplet outer gunpowder box from FIG. 1. 2: side-hung gunpowder boxes; 3: a middle gunpowder box; 32: an inner groove; 33: a through hole.

As shown in FIGS. 1 and 2, the multi-frac composite perforating device of this embodiment comprises three types of gunpowders with different burning rates, and the perforating device adopts a cylinderial charge frame. A triplet outer gunpowder box 4 is attached onto the outer wall of the cylindrial charge frame 1, and comprises a middle gunpowder box 3 and two side-hung gunpowder boxes 2A and 2B. The gunpowder P charged in the middle gunpowder box 3 outside the charge frame is high burning rate gunpowder, the gunpowder Q charged in the inner gunpowder box (not shown in the figure) between adjacent perforating charges inside the charge frame is low burning rate gunpowder and the gunpowders R1 and R2 charged in the side-hung gunpowder boxes 2A and 2B of the triplet outer gunpowder box are middle burning rate gunpowders with the same burning rate. There is no proppant charged in the side-hung gunpowder boxes 2A and 2B in this embodiment. The endpoint of combustion of the high burning rate gunpowder is 60 ms, the endpoint of combustion of the low burning rate gunpowder is 600 ms, and the endpoints of combustion of the middle burning rate gunpowders R1 and R2 are both 210 ms. The time difference between the pressure peaks of the middle burning rate gunpowder and the high burning rate gunpowder is 8 ms, and the time difference between the pressure peaks of the low burning rate gunpowder and the middle burning rate gunpowder is 25 ms.

In this embodiment, the connection between the middle gunpowder box 3 and the two side-hung gunpowder boxes 2A and 2B is achieved by a hinge joint. The hinge shafts 31 are provided on both sides of the middle gunpowder box 3, a hinge hook 21 is provided on one side of the side-hung gunpowder box 2, and the side-hung gunpowder box and the middle gunpowder box are hinged together through hinge hook 21 and hinge shafts 31. Side-hung gunpowder box 2 has claws 22, 23 on its inner side, and said claws fit into the installation holes and grooves of the cylindrical charge frame. The middle gunpowder box 3 is located at a position corresponding to the open end of a perforating charge, and has an inner groove 32 for orienting the perforating bullet and a through hole 33 through which the jet flow passes. In this embodiment, inner groove 32 is of the circular arc shape, and through hole 33 is a round hole.

Figure 3:
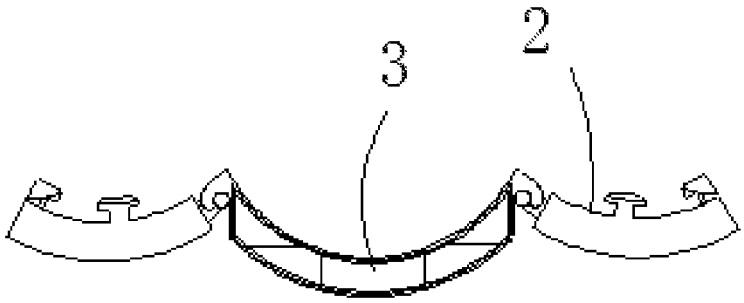
FIG. 3 shows the unfolded triplet outer gunpowder box from FIG. 1. 2: side-hung gunpowder boxes; 3: a middle gunpowder box.
Figure 4:
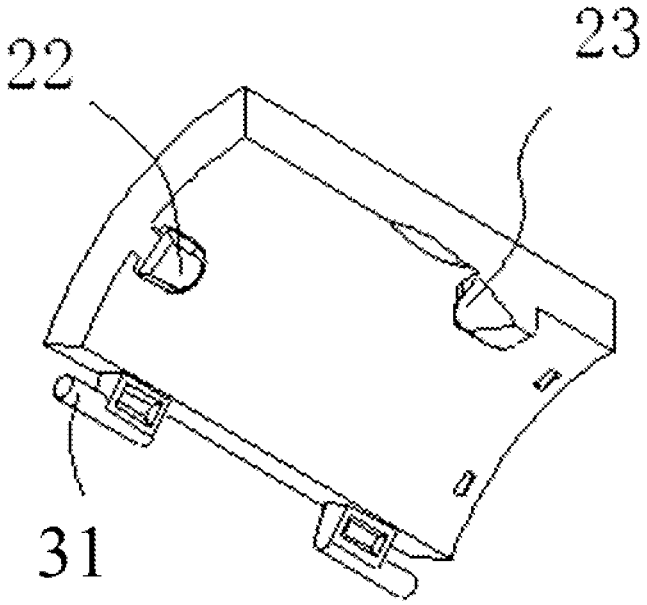
FIG. 4 shows the perspective view of the side-hung gunpowder box from FIG. 1. 31: a hinge shaft; 22: a second claw; 23: a first claw.

FIG. 3 shows the unfolded triplet outer gunpowder box. Many triplet outer gunpowder boxes can be stacked together during packing, so that the space occupied is small and is easy to store and transport. As shown in FIG. 4, two hinge shafts 21 are provided on one sidewall of the side-hung gunpowder box for hinging with the middle gunpowder box.

Figure 5:
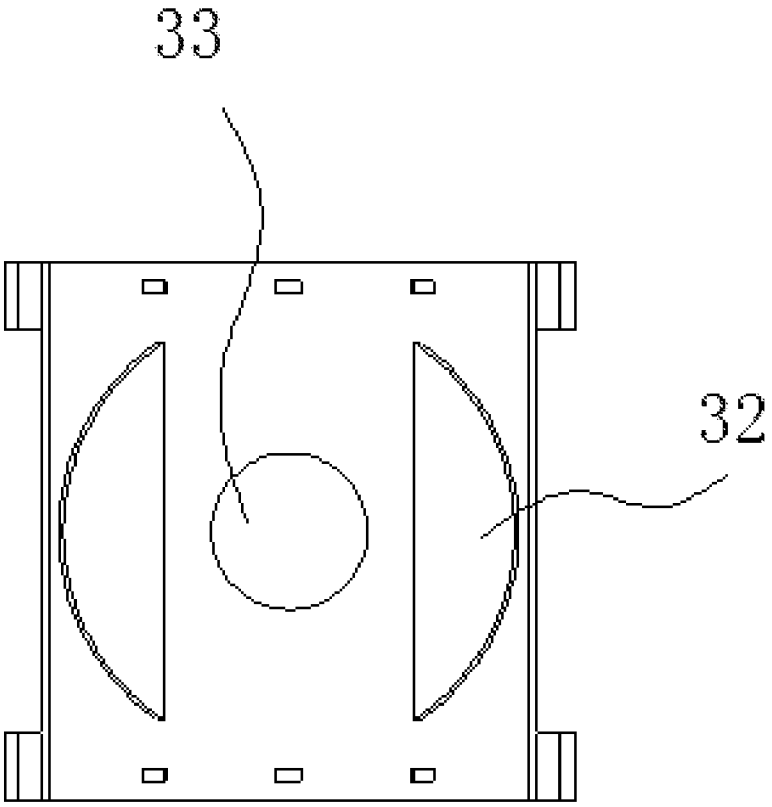
FIG. 5 shows the inner side of the middle gunpowder box from FIG. 1. 32: an inner groove; 33: a through hole.
Figure 6:
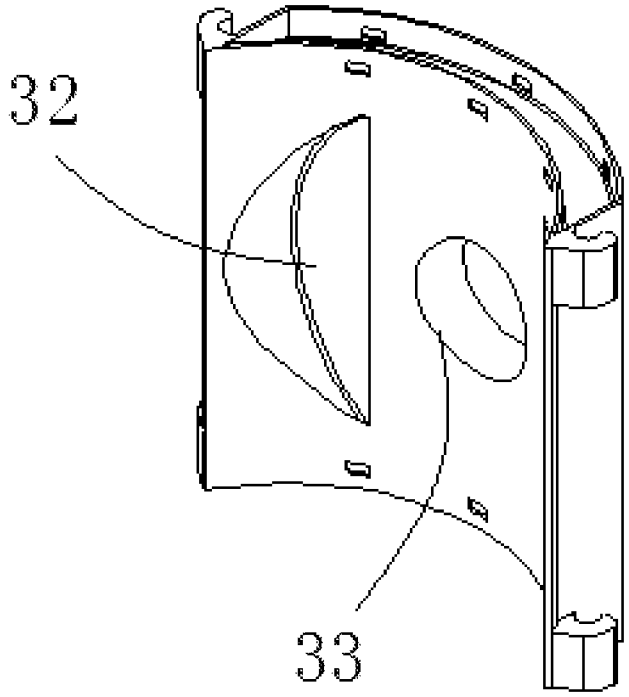
FIG. 6 shows the perspective view of the middle gunpowder box from FIG. 1. 32: an inner groove; 33: a through hole.

As shown in FIGS. 5 and 6, through hole 33 is provided in the center of the middle gunpowder box 3 for the jet flow, groove 32 for orienting the perforating bullet is provided on the inner side of the middle gunpowder box 3, i. e. the open end of the perforating charge is inserted into groove 32.

In this embodiment, the side-hung gunpowder boxes 2A and 2B of the triplet outer gunpowder box 4 are attached onto the outer wall of the cylindrical charge frame 1 by clamping, e.g. first claws 23 are provided in the inner side of each of the side-hung gunpowder boxes 2A and 2B near one of their edges, and said claws is an elastic claw. A second claw 22 is provided in inner side of the side-hung gunpowder boxes 2A and 2B at the center of one of the edges; first claws 23 are fitted into the installation hole of the cylindrical charge frame while second claw 22 is inserted into the groove of the cylindrical charge frame.

When installing the triplet outer gunpowder box 4, the inner side of the outer powder case 4 is abutted to the outer surface of charge frame 1, first claws 23 of the side-hung powder cases 2A and 2B is fitted into the installation hole of the charge frame 1, and second claw 22 is aligned with the groove of the charge frame 1. The outer gunpowder box 4 is slided along the groove on the charge frame, are thus hung on the charge frame without removing the locating ring; the assembling or disassembling process is therefore simple and safe.

EXAMPLE 2

Figure 7:
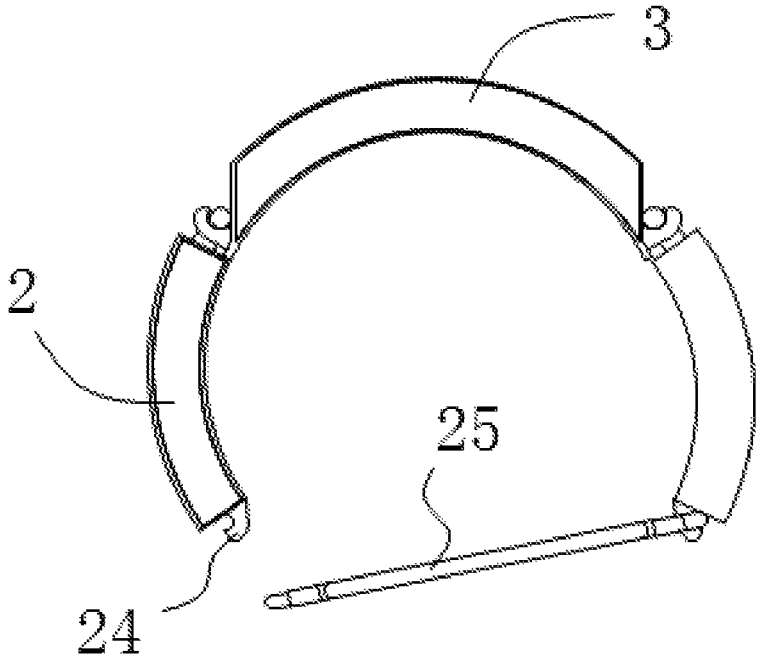
FIG. 7 shows the structure of the triplet outer gunpowder box in Example 2. 2: side-hung gunpowder boxes; 3: a middle gunpowder box; 24: a lock hook; 25: a lock catch.
Figure 8:
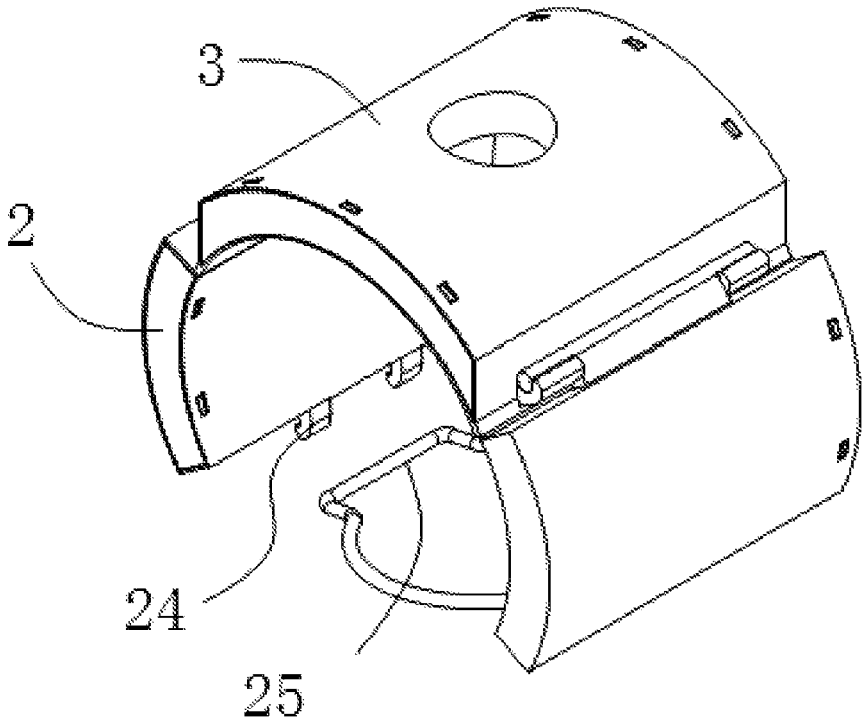
FIG. 8 shows the perspective view of the triplet outer gunpowder box in FIG. 7. 2: side-hung gunpowder boxes; 3: a middle gunpowder box; 24: a lock hook; 25: a lock catch.
Figure 9:
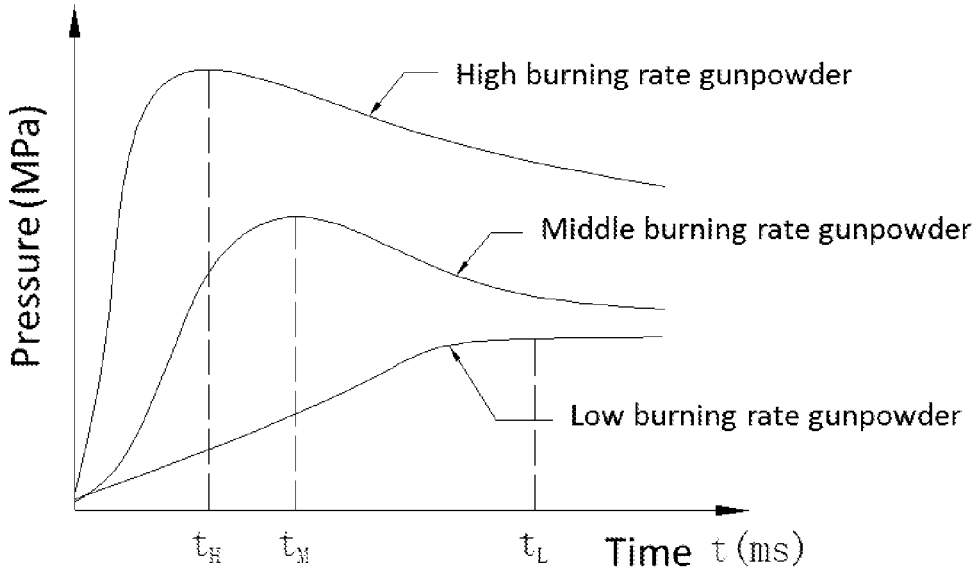
FIG. 9 shows the pressure-time (P-t) graph of the high burning rate gunpowder, the middle buring rate gunpowder, and the low burning rate gunpowder.
Figure 10:
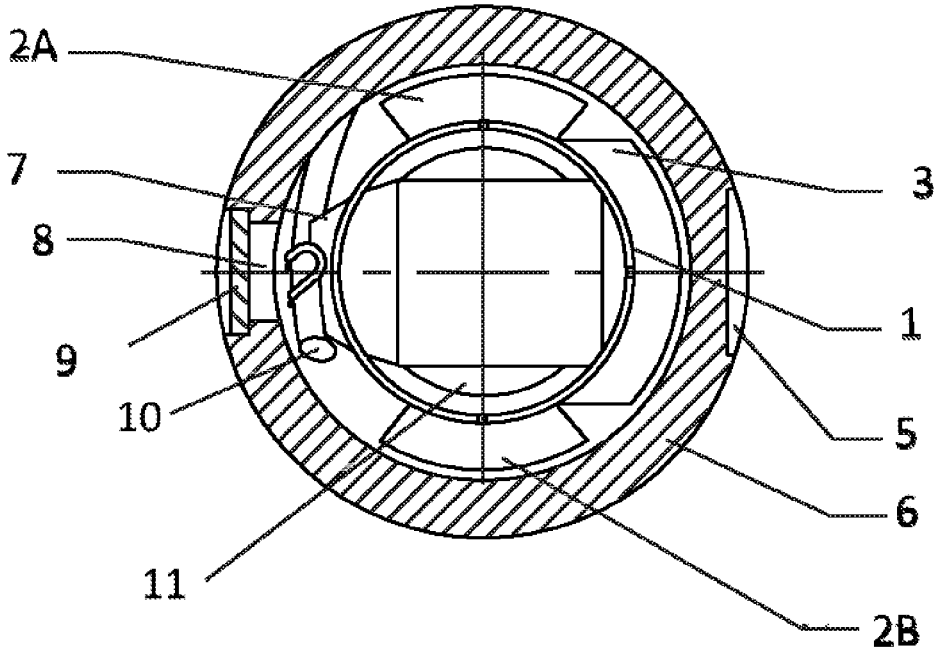
FIG. 10 shows the cross-section of a multi-frac composite perforating device comprising one or more perforating charges and a gun body having a pressure releasing structure facing the closed end of the perforating charge where the pressure releasing structure is a stepped through hole and a sealing cap is mounted on the step of said stepped through hole. When the perforating charge is detonated, the pressure releasing structure would allow the pressure within the gun to be released quickly into the perforation tunnel. Consequently, pressure within the perforation tunnel will be increased quickly, thereby improving the effect of the fracturing. 1: charge frame; 2A, 2B: side-hung gunpowder boxes; 3: a middle gunpowder box; 5: scallop/recesses (facing the open end of perforating charge); 6: gun body (perforating portion); 7: perforating charge; 8: pressure releasing structure (facing the closed end of perforating charge); 9: sealing cap; 10: detonation cord; 11: inner gunpowder box.
Figure 11:
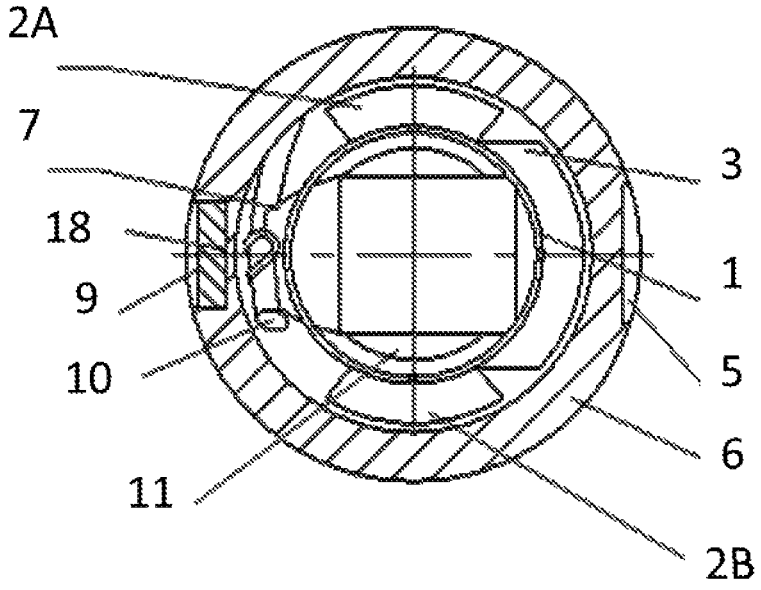
FIG. 11 shows the cross-section of a multi-frac composite perforating device comprising one or more perforating charges and a gun body having a recess on the outer surface facing the closed end of the perforating charge where a sealing cap is mounted in the recess. The sealing cap in the recess protects the recess from succumbing to the high pressure outside the gun when the perforating gun is deployed in a well. When the perforating charge is detonated, since the gun body is thinner at the recess on the outer surface facing the closed end of the perforating charge, the high pressure gases generated by the detonation will break the gun body at the recess and removes the sealing cap such that a pressure releasing hole would be created and the high pressure gases within the gun would be released quickly into the perforation tunnel. 1: charge frame; 2A, 2B: side-hung gunpowder boxes; 3: a middle gunpowder box; 5: scallop/recesses (facing the open end of perforating charge); 6: gun body (perforating portion); 7: perforating charge; 9: sealing cap; 10: detonation cord; 11: inner gunpowder box; 18: scallop/recesses (facing the closed end of perforating charge).
Figure 12:
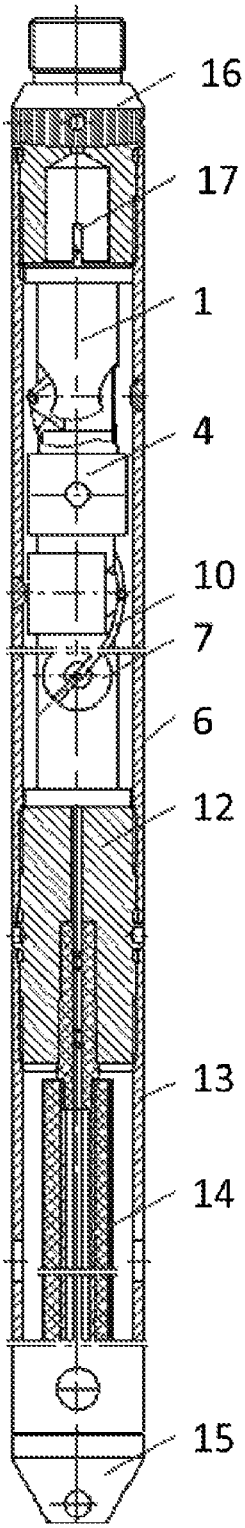
FIG. 12 shows the longitudinal-section of an embodiment of the multi-frac composite perforation device of this invention comprising an upper perforating portion and a lower fracturing portion wherein the upper perforating portion comprises 1: charge frame; 4: a triplet outer gunpowder box; 6: gun body (perforating portion); 7: perforating charge; 16: perforating head; 17: detonator and the fracturing portion comprises 10: detonation cord; 12: adaptor; 13: gun body (fracturing portion); 14: column of gunpowder for fracturing; 15: bottom nose; the adaptor 12 connects the perforating portion and fracturing portion such that the column of gunpowder for fracturing is detonated after the perforating portion is ignited, the high temperature and high pressure produced would be released into the perforation tunnel to extend the fissure.

As shown in FIGS. 7 and 8, the side-hung gunpowder boxes 2A and 2B in the triplet outer gunpowder box 4 in this embodiment are attached onto the outer wall of the cylindrical charge frame 1 by a spring jig which implements the connection to the charge frame by the structure of a lock hook and a lock catch, e.g., two lock hooks 24 are provided on the outer edge of the side-hung gunpowder box 2A, while a lock catch 25 matching with the lock hook 24 is provided on the outer edge of the side-hung gunpowder box 2B; one end of the lock catch 25 is hinged on the outer edge of side-hung gunpowder box 2B, while the other end is free for fitting into the lock hook 24. When assembling the triplet outer gunpowder box 4, the outer gunpowder box 4 only need to be placed on the exact charge position on the charge frame 1, such that the inner side of the outer powder case 4 is abutted on the outer surface of charge frame 1, and the free end of the lock catch 25 may be locked with the lock hook 24. This type of outer gunpowder box structure is even simpler to assemble on the charge frame and conducive for on-site assembly.

The other structures and the types and parameters of the gunpowders etc in this embodiment are the same as those in Example 1.

What is claimed is:

1. A multi-frac composite perforation device comprising (i) a gun body having an outer wall, (ii) an inner gunpowder box between adjacent perforating charges in the charge frame 1 of said perforation device, and (iii) a structure for gunpowder charge comprising an outer gunpowder box 4 attached to an outer wall of the charge frame 1, wherein said outer gunpowder box 4 comprises a middle gunpowder box 3 and two side-hung gunpowder boxes 2A and 2B, wherein said boxes 2A and 2B are separately located on the two sides of said middle gunpowder box 3, and wherein the gunpowders charged in said inner gunpowder box and outer gunpowder box 4 are classified into three types: high burning rate gunpowder having combustion endpoint of 25~80 ms, middle burning rate gunpowder having combustion endpoint of 80~280 ms and low burning rate gunpowder having combustion endpoint of 300~800 ms; wherein said gun body comprises a pressure releasing structure corresponding to a closed end of the perforating charge.

2. The multi-frac composite perforation device of claim 1, wherein said pressure releasing structure is a stepped through hole and a sealing cap is mounted on the step of said stepped through hole.

3. The multi-frac composite perforation device of claim 1, wherein said pressure releasing structure is a recess having a sealing cap mounted in said recess.

4. The multi-frac composite perforation device of claim 1, wherein the thickness of said outer wall of the gun body is varied according to the pressure required to fracture a formation.

5. The multi-frac composite perforation device of claim 1, wherein the thickness of said outer wall of the gun body is 10-12 mm when ≥80 MPa is required for fracturing a formation.

6. The multi-frac composite perforation device of claim 1, wherein the thickness of said outer wall of the gun body is 8-10 mm when ≤80 MPa is required for fracturing a formation.

7. The multi-frac composite perforation device of claim 1, wherein the time difference between the pressure peaks of the middle burning rate gunpowder and the high burning rate gunpowder is about 5~10 ms, and the time difference between the pressure peaks of the low burning rate gunpowder and the middle burning rate gunpowder is about 20~50 ms.

8. The multi-frac composite perforation device of claim 1, wherein the middle gunpowder box 3 and the two side-hung gunpowder boxes 2A and 2B are connected by a hinging mechanism, strapping with flexible belt or bonding with adhesive.

9. The multi-frac composite perforation device of claim 1, wherein said middle gunpowder box 3 is located at a position corresponding to the jet emitting end of a perforating charge.

10. The multi-frac composite perforation device of claim 1, wherein said middle gunpowder box 3 has an inner side comprising an inner groove 32 for orienting the perforating charge and a through hole 33 through which the jet flow passes.

11. The multi-frac composite perforation device of claim 1, wherein the outer gunpowder box 4 is attached to said outer wall of the charge frame 1 by means of:

clamping, wherein the inner side of the side-hung gunpowder boxes 2A and 2B has claws 22 and 23 for fitting into the installation holes of said charge frame 1 or inserting into the grooves of said charge frame 1; or, spring jig, wherein gunpowder box 4 is attached to said outer wall of the charge frame 1 by a matching structure of a lock hook 24 and a lock catch 25.

12. A perforation device comprising a perforating portion and a fracturing portion which are connected by an adaptor, wherein said fracturing portion comprises at least one column of gunpowder for fracturing, and said perforating portion comprises (i) a gun body having an outer wall, (ii) an inner gunpowder box between adjacent perforating charges in the charge frame 1 of said perforation device, and (iii) a structure for gunpowder charge comprising an outer gunpowder box 4 attached to an outer wall of the charge frame 1, wherein said outer gunpowder box 4 comprises a middle gunpowder box 3 and two side-hung gunpowder boxes 2A and 2B, wherein said boxes 2A and 2B are separately located on the two sides of said middle gunpowder box 3, and wherein the gunpowders charged in said inner gunpowder box and outer gunpowder box 4 are classified into three types: high burning rate gunpowder having combustion endpoint of 25~80 ms, middle burning rate gunpowder having combustion endpoint of 80~280 ms and low burning rate gunpowder having combustion endpoint of 300~800 ms; wherein said gun body comprises a pressure releasing structure corresponding to a closed end of the perforating charge.

13. A method of using multi-frac composite perforating device to fracture a formation, wherein said multi-frac composite perforating device comprises (i) a gun body having an outer wall, (ii) an inner gunpowder box between adjacent perforating charges in the charge frame 1 of said perforation device, and (iii) a structure for gunpowder charge comprising an outer gunpowder box 4 attached to an outer wall of the charge frame 1, wherein said outer gunpowder box 4 comprises a middle gunpowder box 3 and two side-hung gunpowder boxes 2A and 2B, wherein said boxes 2A and 2B are separately located on the two sides of said middle gunpowder box 3, and wherein the gunpowders charged in said inner gunpowder box and outer gunpowder box 4 are classified into three types: high burning rate gunpowder having combustion endpoint of 25~80 ms, middle burning rate gunpowder having combustion endpoint of 80~280 ms and low burning rate gunpowder having combustion endpoint of 300~800 ms; wherein said gun body comprises a pressure releasing structure corresponding to a closed end of the perforating charge;

said method comprising the steps of:

charging said middle gunpowder box and said two side-hung gunpowder boxes with one or more types of gunpowders selected from the group consisting of high burning rate gunpowder having combustion endpoint of 25~80 ms, middle burning rate gunpowder having combustion endpoint of 80~280 ms, and low burning rate gunpowder having combustion endpoint of 300~800 ms; and placing said device in the formation to fracture said formation.

14. The method of claim 13, wherein the gunpowders charged in said middle and side-hung gunpowder boxes are of the same or different types.

15. The method of claim 13, wherein for formations requiring ≥80 MPa to fracture or brittle formations, the combination of gunpowders used is 50% to 100% high burning rate gunpowder, 0% to 25% middle burning rate gunpowder and 0% to 25% low burning rate gunpowder.

16. The method of claim 13, wherein for formations requiring ≥80 MPa to fracture or contaminated formations, the combination of gunpowders used is 0% to 25% high burning rate gunpowder, 0% to 25% middle burning rate gunpowder and 50% to 100% low burning rate gunpowder.

17. The method of claim 13, wherein the thickness of the outer wall of said gun body is varied according to the pressure required to fracture a formation.

18. The method of claim 17, wherein the thickness of said outer wall is 10-12 mm when ≥80 MPa is required for fracturing a formation.

19. The method of claim 17, wherein the thickness of said outer wall is 8-10 mm when ≥80 MPa is required for fracturing a formation.

* * * * *